US005582458A

United States Patent [19]

Wildt

[11] Patent Number: 5,582,458

[45] Date of Patent: Dec. 10, 1996

[54] PORTABLE LOUNGE CHAIR

[76] Inventor: Debbie L. Wildt, 1065 S. Hunter Rd., Indianapolis, Ind. 46239

[21] Appl. No.: 599,330

[22] Filed: Feb. 9, 1996

[51] Int. Cl.[6] ..... A47C 7/62; A47C 29/00

[52] U.S. Cl. ..... 297/184.15; 297/188.01; 297/183.5; 297/54

[58] Field of Search ..... 297/184.15, 31, 297/16.2, 188.01, 188.06, 188.07, 188.08, 188.12, 423.26, 183.5, DIG. 6

[56] References Cited

U.S. PATENT DOCUMENTS

| | | | |
|---|---|---|---|
| 2,752,929 | 7/1956 | Berger | 297/31 |
| 3,479,085 | 11/1969 | Weinstein | 297/188.06 X |
| 3,947,903 | 4/1976 | Menke | 297/188.01 X |
| 4,273,380 | 6/1981 | Silvestri | 297/188.06 |
| 4,441,756 | 4/1984 | Liou et al. | 297/423.26 X |
| 4,466,659 | 8/1984 | Carpenter | 297/188.06 |
| 4,687,248 | 8/1987 | Ross et al. | 297/188.01 X |
| 4,687,249 | 8/1987 | Mills | 297/183.5 X |
| 4,725,094 | 2/1988 | Greer | 297/188.06 X |
| 4,824,168 | 4/1989 | Makoski | 297/188.06 X |
| 4,877,288 | 10/1989 | Lee | 297/188.06 X |
| 4,921,301 | 5/1990 | Haynes | 297/284.1 X |
| 4,949,887 | 8/1990 | Holmes | 297/188.01 X |
| 5,096,257 | 3/1992 | Clark | 297/184.15 |
| 5,139,308 | 8/1992 | Ziman | 297/188.06 |
| 5,246,265 | 9/1993 | Nagan et al. | 297/31 X |
| 5,275,463 | 1/1994 | Rocha | 297/188.01 X |
| 5,409,291 | 4/1995 | Lamb et al. | 297/188.06 X |
| 5,421,637 | 6/1995 | Lemburg | 297/DIG. 6 X |

*Primary Examiner*—Peter R. Brown
*Assistant Examiner*—Rodney B. White

[57] ABSTRACT

The present invention relates to a portable lounge chair. In its broadest context, the device includes a main panel, a back panel and a canopy panel all pivotally interrelated. The main panel further includes two depending side carrying panels for use in carrying suntan lotion, sodas or other accessories. Furthermore the canopy panel includes two depending sunshades. The details as to the various components of the device, and the manner in which they interrelate will be described in greater detail hereinafter.

1 Claim, 3 Drawing Sheets

PORTABLE LOUNGE CHAIR

BACKGROUND OF THE INVENTION

1. Field of the Invention

The present invention relates to portable lounge chair and more particularly pertains to a lounge chair with storage pouches.

2. Description of the Prior Art

The use of lounge chairs is known in the prior art. More specifically, lounge chairs heretofore devised and utilized for the purpose of supporting a user are known to consist basically of familiar, expected, and obvious structural configurations, notwithstanding the myriad of designs encompassed by the crowded prior art which has been developed for the fulfillment of countless objectives and requirements.

For example, U.S. Pat. Nos. 5,320,405 to Foster et al.; 5,139,308 to Ziman; 4,687,248 to Ross et al.; 5,326,152 to Baron all disclose various lounge chairs and seats. Furthermore, U.S. Pat. No. 5,240,330 to Thompson and U.S. Des. Pat. No. 274,019 to Stead et al both pertain to article holders and organizers.

In this respect, the portable lounge chair according to the present invention substantially departs from the conventional concepts and designs of the prior art, and in doing so provides an apparatus primarily developed for the purpose of providing a lounge chair with storage pouches.

Therefore, it can be appreciated that there exists a continuing need for new and improved portable lounge chair which can be used for storing beverages and associated items. In this regard, the present invention substantially fulfills this need.

SUMMARY OF THE INVENTION

In view of the foregoing disadvantages inherent in the known types of lounge chairs now present in the prior art, the present invention provides an improved portable lounge chair. As such, the general purpose of the present invention, which will be described subsequently in greater detail, is to provide a new and improved portable lounge chair and method which has all the advantages of the prior art and none of the disadvantages.

To attain this, the present invention essentially comprises a portable lounge chair a main panel having a first side tubular member, a second side tubular member, a forward extent, a rearward extent, an upper surface and a lower surface. A fabric material is secured between the first side tubular member of the main panel and the second side tubular member of the main panel. The chair includes a first side carrying panel which is defined by an upper extent and a lower extent. The upper extent of the first side carrying panel is secured to the first side tubular member of the main panel. Furthermore, a plurality of pockets are positioned upon the first side carrying panel, with each of the pockets having an opened upper end, closed lower end and an interior surface. Elastic closure means are associated with the opened end of each of these pockets. At least one of these panels has an insulating material positioned over its interior surface. The main panel includes a second side carrying panel which has an upper extent and a lower extent. The upper extent of the second side carrying panel is secured to the second side tubular member of the main panel. A plurality of pockets are positioned upon the second side carrying panel. Each of these pockets have an opened upper end, a closed lower end and an interior surface. Elastic closure means are associated with the opened end of each of the pockets. At least one of these panels has an insulating material positioned over its interior surface. The chair further includes a backrest panel which is defined by a first side tubular member, a second side tubular member, a forward extent, a rearward extent, a forward surface and a rearward surface. A fabric material is secured between the first side tubular member of the backrest panel and the second side tubular member of the backrest panel. The forward extent of this backrest panel is pivotally secured to the rearward extent of the main panel. A pouch is secured to the rearward surface of the backrest panel. This pouch has a closed lower end and an opened upper end. Elastic closure means are associated with the opened upper end of the pouch. An upper strap is secured to the backrest panel, likewise a lower strap is secured to the backrest panel. Each of these straps has a first end and a second end with an intermediate extent therebetween. Additionally, each of these straps includes a pile type fasteners secured along its length. The chair also includes a canopy panel which is defined by a first side tubular member, a second side tubular member, a forward extent, a rearward extent, an upper surface and a lower surface. A fabric member is secured between the first side tubular member of the canopy panel and the second side tubular member of the canopy panel. A plurality of pile type fasteners are secured to the lower surface of the canopy panel. A first side sunshade and a second side sunshade are interconnected to the canopy panel. Each of these sunshades is defined by an upper extent, a lower extent, an interior area and an exterior area. The upper extent of the first side sunshade is secured to the first side tubular member of the canopy panel, and the upper extent of the second side sunshade is secured to the second side tubular member of the canopy panel. Furthermore, a pile type fastener is secured to the lower extent interior area of each of the sunshades. Thus, each of these sunshades is adapted to be selectively secured to the lower surface of the canopy panel by way of the pile type fasteners on the lower extent interior area of each of the sunshades and on the lower surface of the canopy panel. The rearward extent of the canopy panel is both telescopically and pivotally secured to the rearward extent of the backrest panel. A carry strap can be employed to transport the char. This carry strap is defined by a first end with an associated fastener, a second end with an associated fastener, and an intermediate extent therebetween. The first end of this carry strap is adapted to be secured to the first side tubular member of the canopy panel adjacent the rearward extent, and the second end of the carry strap is adapted to be secured to the second side tubular member of the canopy panel adjacent the rearward extent. The chair additionally includes a legrest panel which is defined by a first side tubular member and a second side tubular member. As with the other panels, a fabric panel is secured between the first side tubular member and the second side tubular member. The rearward extent of the legrest panel is pivotally secured to the forward extent of the main panel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved portable lounge chair which have all the advantages of the prior art lounge chairs and none of the disadvantages.

It is another object of the present invention to provide new and improved portable lounge chair which may be easily and efficiently manufactured and marketed.

It is further object of the present invention to provide new and improved portable lounge chair which are of durable and reliable constructions.

An even further object of the present invention is to provide new and improved portable lounge chair which are susceptible of a low cost of manufacture with regard to both materials and labor, and which accordingly are then susceptible of low prices of sale to the consuming public, thereby making such portable lounge chair economically available to the buying public.

Still yet another object of the present invention is to provide new and improved portable lounge chair which provide in the apparatuses and methods of the prior art some of the advantages thereof, while simultaneously overcoming some of the disadvantages normally associated therewith.

Even still another object of the present invention is to provide lounge chair with storage pouches.

Lastly, it is an object of the present invention to provide new and improved portable lounge chair. In its broadest context, the present invention includes a main panel, a back panel and a canopy panel all pivotally interrelated. The main panel further includes two depending side carrying panels for use in carrying suntan lotion, sodas or other accessories. Furthermore the canopy panel includes two depending sunshades. The details as to the various components of the present invention, and the manner in which they interrelate will be described in greater detail hereinafter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
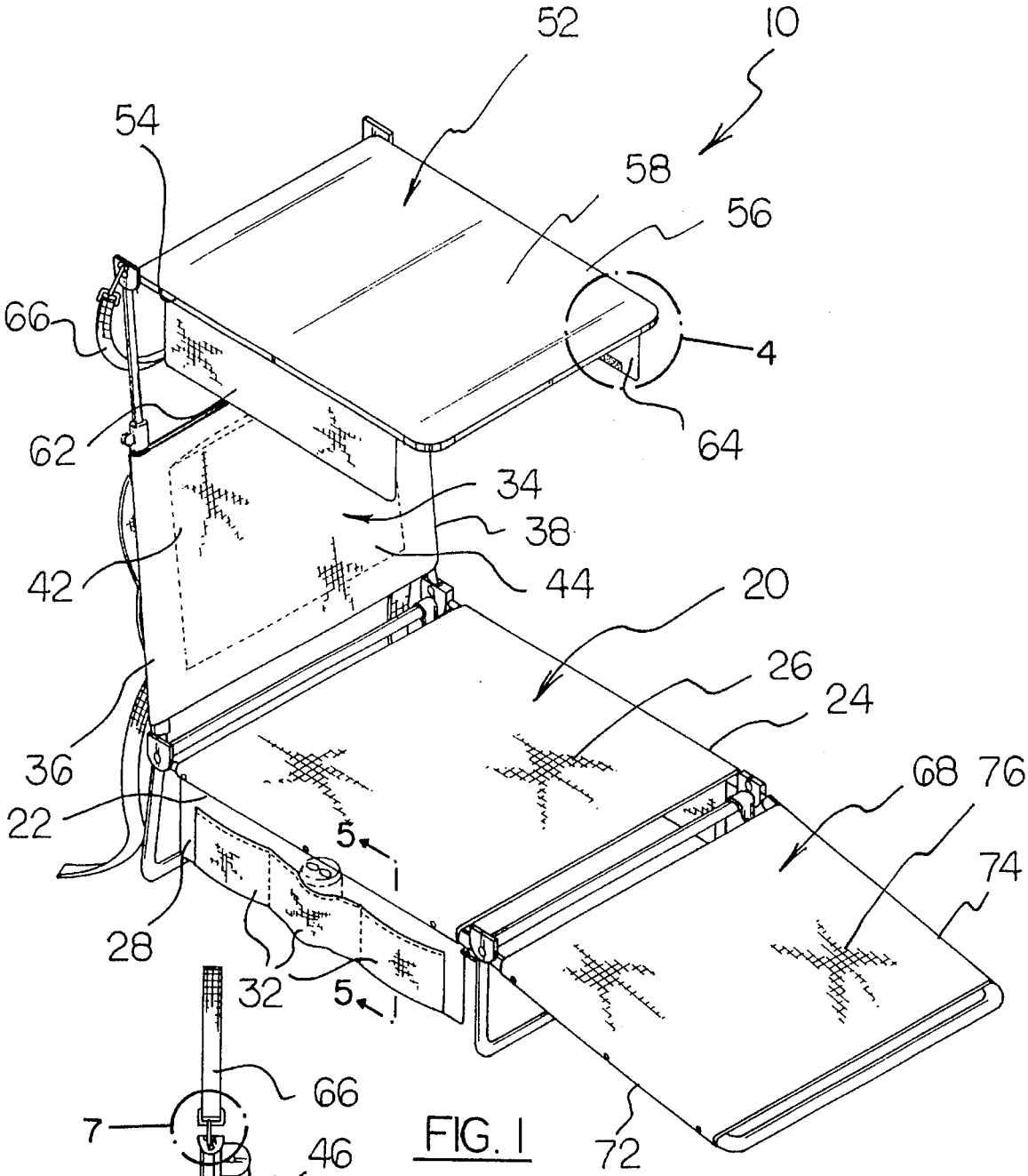
FIG. 1 is a perspective view of the preferred embodiment of the portable lounge chair constructed in accordance with the principles of the present invention.
Figure 2:
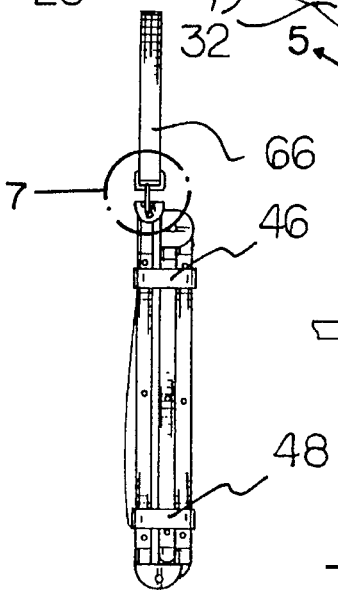
FIG. 2 is a side view of the preferred embodiment of the portable chair in its folded orientation.

With reference now to the drawings, and in particular to FIG. 1 thereof, the preferred embodiment of the new and improved portable lounge chair embodying the principles and concepts of the present invention and generally designated by the reference numeral 10 will be described.

The present invention relates to a portable lounge chair. In its broadest context, the present invention includes a main panel, a back panel and a canopy panel all pivotally interrelated. The main panel further includes two depending side carrying panels for use in carrying suntan lotion, sodas or other accessories. Furthermore the canopy panel includes two depending sunshades. The details as to the various components of the present invention, and the manner in which they interrelate will be described in greater detail hereinafter.

Figures 5, 6:
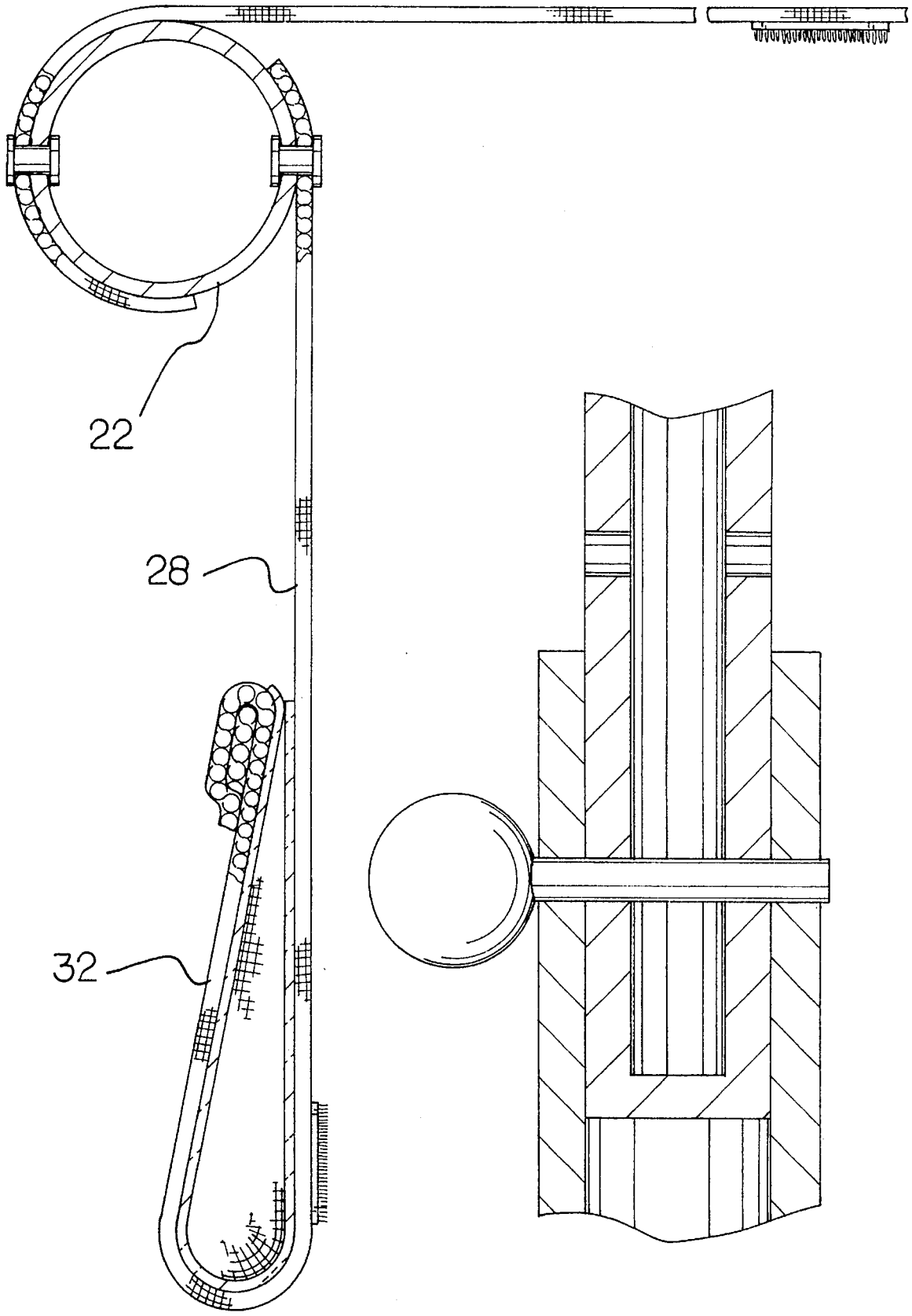
FIG. 5 is a view taken along line 5—5 of FIG. 1.
FIG. 6 is a sectional view of the pin used to secure the telescopic connection between the backrest panel and the canopy panel.

The main panel 20 includes a first side tubular member 22 and a second side tubular member 24. Furthermore, the main panel is defined by a forward extent, a rearward extent, an upper surface and a lower surface. Additionally, a fabric material 26 is secured between the first side tubular member 22 of the main panel 20 and the second side tubular member 24 of the main panel 20. This securement can be achieved by way of rivets. Such a securement arrangement can most clearly be seen with reference to FIG. 5.

A first side carrying panel 28, which is defined by an upper extent and a lower extent, has its upper extent secured to the first side tubular member 22 of the main panel 20. This securement can be achieved by way of a rivet. The first side carrying panel 28 as it is attached to the first side tubular member 22 can most clearly be seen with reference to FIG. 5. A plurality of pockets 32 are positioned upon the first side carrying panel 22. In the preferred embodiment there are three such pockets. Each of these pockets 32 are defined by an opened upper end, closed lower end and an interior surface. Elastic closure means are associated with the opened end of each of the pockets. This closure means can take the form of an elastic strip of material which can be secured within the periphery of the opened upper end of the pocket. Thus, the pocket in its undisturbed state is closed. A user wishing to gain access to the interior of the pocket must open the upper extent against the tension of the elastic. Furthermore, for the purposes of keeping a drink cold or warm at least one of the panels has an insulating material positioned over its interior surface. This insulating material functions to retain heat and maintain the temperature of a beverage container. In the preferred embodiment only the middle of the three pockets is insulated. In an alternative embodiment, each of the side carry panels includes a portion of pile fastener secured at its lower interior area. Additionally, the undersurface of the main panel includes corresponding pile type fasteners. Thus, if a user wishes to secure either or both of the side carry panels to the undersurface of the main panel they may do so.

The lounge chair includes a second side carrying panel which is identical to the first side carrying panel and positioned at the opposite side of the chair. Specifically, the second side carrying panel includes an upper extent and a lower extent, with the upper extent of the second side carrying panel secured to the second side tubular member of the main panel. Furthermore, a plurality of pockets are positioned upon the second side carrying panel, with each of the pockets having an opened upper end, closed lower end and an interior surface. As with the first side, elastic closure means are associated with the opened end of each of the pockets. In the preferred embodiment of the second side carrying panel there are three such pockets with the middle pocket being insulated. With each carrying panel the preferred embodiment has been described as three pockets with the middle pocket being insulated. However, any number of pockets may be employed with any number of the pockets being insulated.

The backrest panel 34 includes a first side tubular member 36 and a second side tubular member 38. Furthermore, the backrest panel 34 is defined by a forward extent, a rearward extent, a forward surface and a rearward surface. As with the main panel 20, a fabric material 42 is secured between the first side tubular member 36 of the backrest panel 34 and the second side tubular member 38 of the backrest panel 34. The forward extent of the backrest panel 34 is pivotally secured to the rearward extent of the main panel 20. More specifically, the first side tubular member 22 of the main panel 20 is pivotally secured to the first side tubular member 36 of the backrest panel 34. Furthermore, the second side tubular member 24 of the main panel 20 is pivotally secured to the second side tubular member 38 of the backrest panel 34. Each of these pivotal connections, as well as the previously described pivotal connections can be ratchet type pivotal connections. More specifically, pivotal connections which allow positive securement at a number of discrete positions.

As can be seen with reference to FIG. 1, a pouch 44 is secured to the rearward surface of the backrest panel 34. This pouch 44 has a closed lower end and an opened upper end and is sewn at it periphery to the backrest fabric panel 42. As with the pockets of the carrying panels previously described, an elastic closure means is associated with the opened upper end of the pouch.

In order to allow the entire lounge chair to be properly secured two straps are included. These straps are adapted to encircle the entire chair when it is in its collapsed orientation. The collapsed orientation is achieved when all the panel members are folded onto one another. Specifically, an upper 46 and a lower strap 48 are secured to the backrest panel 34. Each of these straps 46 and 48 has a first end and a second end and with an intermediate extent therebetween. The intermediate extent of each strap is secured to the rearward extend of the backrest panel 34 approximate the first side tubular member 36. Additionally, each of these straps 46 and 48 further includes pile type fasteners secured at their intermediate extends. Thus, with the chair 10 in its collapsed orientation, the upper and lower straps 46 and 48 can each be wrapped around the entirety of the chair to keep it from unfolding. The pile type fasteners are secured to both sides of each strap such that each strap can be secured to itself once it is wrapped around the chair.

The canopy panel 52 includes a first side tubular member 54, as well as a second side tubular member 56. Additionally, the canopy 52 is defined by a forward extent, a rearward extent, an upper surface and a lower surface. A fabric member 58 is secured between the first side tubular member 54 of the canopy panel 52 and the second side tubular member 56 of the canopy panel 52. A plurality of pile type fasteners are secured to the lower surface of the canopy panel 52. The function of these pile type fasteners will be described in greater detail hereinafter. The canopy panel 52 includes both a first side sunshade 62 and a second side sunshade 64. These sunshades 62 and 64 can most clearly been seen in reference to FIG. 1. Each of these sunshades has an upper extent, a lower extent, an interior area and an exterior area. The upper extent of the first side sunshade 62 is secured to the first side tubular member 54 of the canopy panel 52. Likewise, the upper extent of the second side sunshade 64 is secured to the second side tubular member 56 of the canopy panel 52. Additionally, each sunshade includes a pile type fastener secured to its lower extent interior area. Thus, each of the sunshades 62 and 64 is adapted to be selectively secured to the lower surface of the canopy panel 52 by way of the pile type fasteners on the lower extent interior area of each of the sunshades 62 and 64 and on the lower surface of the canopy panel 52. In an alternative embodiment, pile type fasteners are positioned upon the top surface of the canopy panel 52. In this embodiment, each of the sunshades 62 and 64 has an associated pile type fastener positioned on its exterior area lower extent. Thus, each of the sunshades can be folded onto and secured to the upper surface of the canopy panel 52. With either embodiment, a user can selectively secure either of the sunshades to the canopy panel, or leave either sunshade to hang down from the canopy panel. The rearward extent of the canopy panel 52 is both pivotally and telescopically secured the rearward extent of the backrest panel 34. More specifically, the first side tubular member 54 of the canopy panel 52 is adjustably coupled to the first side tubular member 36 of the backrest panel 34. Additionally, the second side tubular member 56 of the canopy panel 52 is adjustably coupled to the second side tubular member 38 of the backrest panel 34. In the preferred embodiment, a pin is inserted into each of the tubular members of the backrest panel and through apertures formed within the tubular members of the canopy panel.

Figure 7:
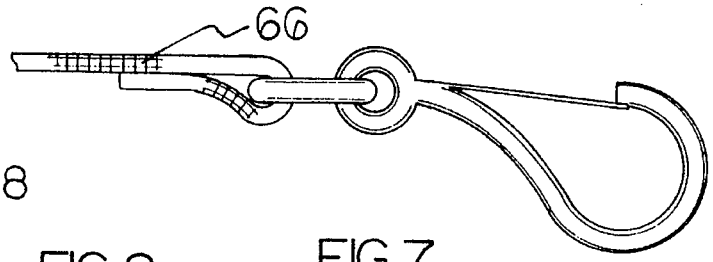
FIG. 7 is an expanded view taken from FIG. 2.
Figure 3:
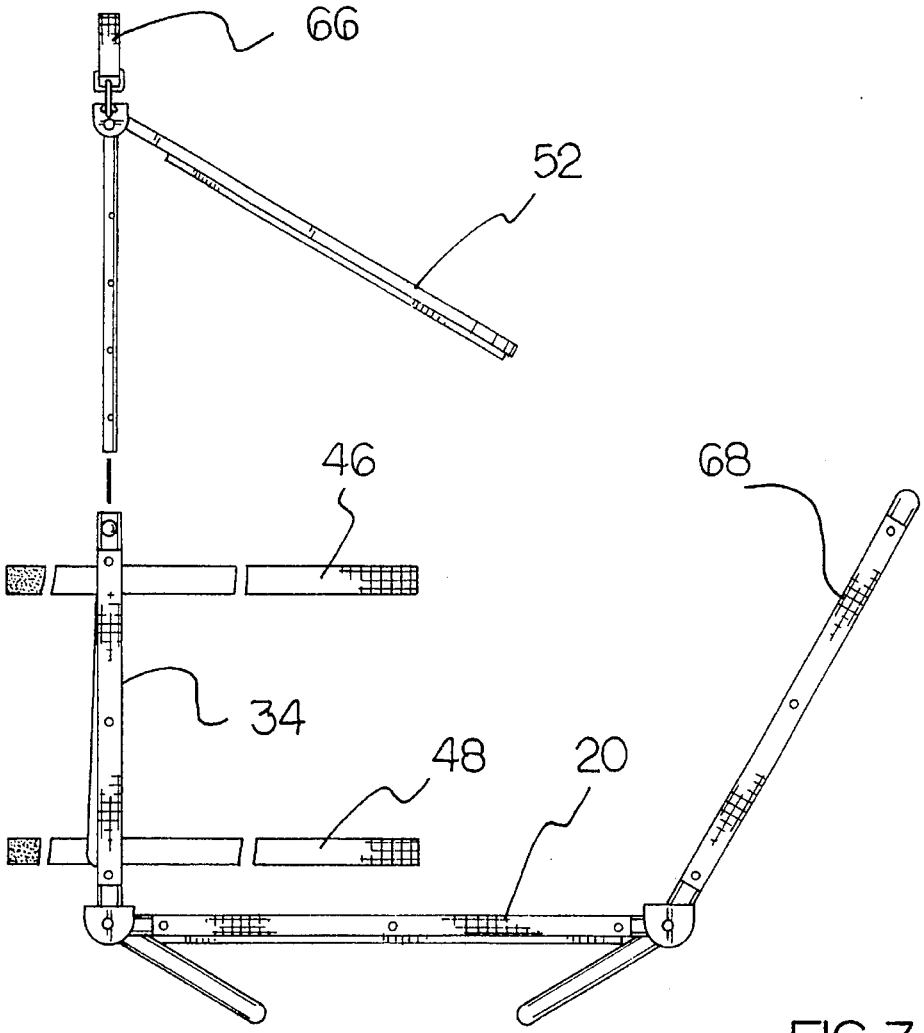
FIG. 3 is a side view of the preferred embodiment of the portable chair in its unfolded orientation.
Figure 4:
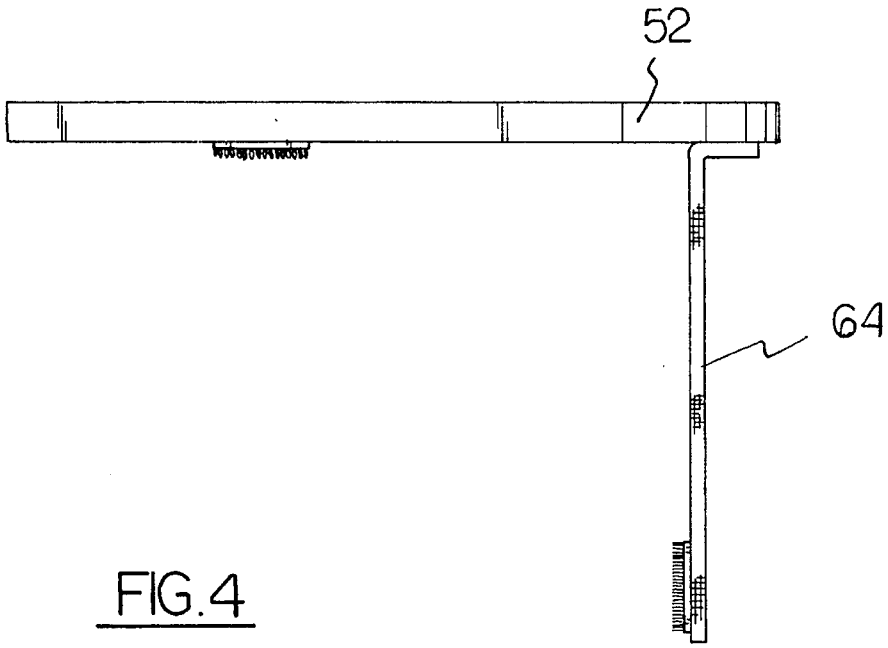
FIG. 4 is an expanded view taken from FIG. 1.

When the chair is in its collapsed orientation a carry strap 66 can be utilized for a user to transport the chair. The carry strap 66 includes a first end with an associated fastener, a second end with an associated fastener, and an intermediate extent. In the preferred embodiment, each of the fasteners is a hook type fastener. The hook type fastener of the preferred embodiment can most clearly be seen in reference to FIG. 7. The first end of the carry strap is adapted to be secured to the first side tubular member of the canopy panel adjacent the rearward extent, and the second end of the carry strap is adapted to be secured to the second side tubular member of the canopy panel adjacent the rearward extent.

The chair 10 is further defined by a legrest panel 68. This panel 68 includes a first side tubular member 72 and a second side tubular member 74. Furthermore, a fabric panel 76 is secured between the first side tubular member 72 and the second side tubular member 76. The rearward extent of the legrest panel 68 is pivotally secured to the forward extent of the main panel 20. More specifically, the first side tubular member 72 of the legrest 68 is pivotally secured to the first side tubular member 22 of the main panel 20. Additionally, the second side tubular member 74 of the legrest panel 68 is pivotally secured to the second side tubular member 24 of the main panel 20. Furthermore, as is depicted in FIG. 1 the entire chair 10 can be supported by two depending legs. These legs are pivotally secured to the underside of the main panel 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable lounge chair comprising in combination:

a main panel having a first side tubular member, a second side tubular member, a forward extent, a rearward extent, an upper surface and a lower surface, a fabric material secured between the first side tubular member of the main panel and the second side tubular member of the main panel;

a first side carrying panel having an upper extent and a lower extent, the upper extent of the first side carrying panel secured to the first side tubular member of the main panel, a plurality of pockets positioned upon the first side carrying panel, each of the pockets having an opened upper end, closed lower end and an interior surface, elastic closure means associated with the opened end of each of the pockets, at least one of the panels having an insulating material positioned over the interior surface;

a second side carrying panel having an upper extent and a lower extent, the upper extent of the second side carrying panel secured to the second side tubular member of the main panel, a plurality of pockets positioned upon the second side carrying panel, each of the pockets having an opened upper end, closed lower end and an interior surface, elastic closure means associated with the opened end of each of the pockets, at least one of the panels having an insulating material positioned over the interior surface;

a backrest panel having a first side tubular member, a second side tubular member, a forward extent, a rearward extent, an forward surface and a rearward surface, a fabric material secured between the first side tubular member of the backrest panel and the second side tubular member of the backrest panel, the forward extent of the backrest panel pivotally secured to the rearward extent of the main panel, a pouch secured to the rearward surface of the backrest panel, the pouch having a closed lower end and an opened upper end, elastic closure means associated with the opened upper end of the pouch, an upper strap secured to the backrest panel, a lower strap secured to the backrest panel, each of the straps having a first end and a second end and an intermediate extent therebetween, each of the straps further including pile type fasteners secured along its length;

a canopy panel having a first side tubular member, a second side tubular member, a forward extent, a rearward extent, an upper surface and a lower surface, a fabric member secured between the first side tubular member of the canopy panel and the second side tubular member of the canopy panel, a plurality of pile type fasteners secured to the lower surface of the canopy panel, a first side sunshade and a second side sunshade, each of the sunshades having an upper extent, a lower extent, an interior area and an exterior area, the upper extent of the first side sunshade secured to the first side tubular member of the canopy panel, the upper extent of the second side sunshade secured to the second side tubular member of the canopy panel, a pile type fastener secured to the lower extent interior area of each of the sunshades, each of the sunshades adapted to be selectively secured to the lower surface of the canopy panel by way of the pile type fasteners on the lower extent interior area of each of the sunshades and on the lower surface of the canopy panel, the rearward extent of the canopy panel adjustably secured to the rearward extent of the backrest panel;

a carry strap having a first end with an associated fastener, second end with an associated fastener, and an intermediate extent therebetween, the first end of the carry strap adapted to be secured to the first side tubular member of the canopy panel adjacent the rearward extent, the second end of the carry strap adapted to be secured to the second side tubular member of the canopy panel adjacent the rearward extent;

a legrest panel having a first side tubular member and a second side tubular member, a fabric panel secured between the first side tubular member and the second side tubular member, a rearward extent of the legrest panel pivotally secured to the forward extent of the main panel.

* * * * *